US005979460A

United States Patent [19]

Matsumura

[11] Patent Number: 5,979,460

[45] Date of Patent: Nov. 9, 1999

[54] METHOD OF PRODUCING TOBACCO FILTERS

[75] Inventor: Hiroyuki Matsumura, Himeji, Japan

[73] Assignee: Daicel Chemical Industries, Inc.

[21] Appl. No.: 09/105,178

[22] Filed: Jun. 26, 1998

Related U.S. Application Data

[62] Division of application No. 08/618,559, Mar. 20, 1996, Pat. No. 5,823,201.

[30] Foreign Application Priority Data

May 31, 1995 [JP] Japan ..... 7-158294

[51] Int. Cl.[6] ..... A24D 3/00; A24D 3/02

[52] U.S. Cl. ..... 131/343; 131/331; 131/332; 131/345

[58] Field of Search ..... 131/331, 343, 131/345, 332

[56] References Cited

U.S. PATENT DOCUMENTS

| | | | |
|---|---|---|---|
| 3,900,037 | 8/1975 | Horsewell et al. . | |
| 4,085,760 | 4/1978 | Toyoshima et al. . | |
| 4,192,838 | 3/1980 | Keith et al. . | |
| 4,283,186 | 8/1981 | Keith et al. . | |
| 5,150,721 | 9/1992 | Lece et al. | 131/331 |
| 5,495,860 | 3/1996 | Teufel et al. | 131/331 |
| 5,823,201 | 10/1998 | Matsumura | 131/343 |

FOREIGN PATENT DOCUMENTS

| | | |
|---|---|---|
| 0641525A2 | 3/1995 | European Pat. Off. . |
| B441944 | 1/1944 | Japan . |
| B441953 | 1/1944 | Japan . |
| B44-1944 | 1/1969 | Japan . |
| 5272900 | 12/1975 | Japan . |
| B50-38720 | 12/1975 | Japan . |
| 52-72900 | 6/1977 | Japan . |
| 52-96208 | 8/1977 | Japan . |
| 53-45468 | 4/1978 | Japan . |
| 55-141185 | 11/1980 | Japan . |
| 5227939 | 9/1993 | Japan . |

OTHER PUBLICATIONS

Database WPI Week 9502/Derwent Publications Ltd; "Biodegradable Cellulose Acetate Fibre Sheet—Having Degree of Acetylation Decreasing Front Surface to Centre", AN 95–012313, XP 002026822, JP 06 299 407 A (Teijin Limited), Oct. 25, 1994.

*Primary Examiner*—James Derrington
*Assistant Examiner*—Kevin Cronin
*Attorney, Agent, or Firm*—Pillsbury Madison & Sutro

[57] ABSTRACT

A tobacco filter with a circumferential length of 17 to 27 mm is prepared by creping or embossing, with a roller of a temperature not lower than 100° C., a sheet-like material comprising not less than 20% by weight of a cellulose ester component and having a web structure with a basis weight of 20 to 35 g/m$^2$ and a density of 0.25 to 0.45 g/cm$^3$, and wrapping up the creped or embossed material into a rod form. The cellulose ester component includes e.g. a cellulose ester short staple, a fibrillated fiber, an esterified fiber and a fiber coated with a cellulose ester. This tobacco filter shows a pressure drop of 200 to 500 mm WG, a firmness of 88% or more and a cross-sectional porosity of 2% or less provided that it has a circumferential length of 24.5 mm and a length of 10 cm.

3 Claims, No Drawings

METHOD OF PRODUCING TOBACCO FILTERS

This is a Divisional of: National Appln. No. 08/618,559 filed Mar. 20, 1996, now U.S. Pat. No. 5,823,201 which designated the U.S.

FIELD OF THE INVENTION

The present invention relates to a tobacco filter which insures excellent eliminating properties of harmful components of tobacco smoke and satisfactory smoking qualities (aroma, taste and palatability of tobacco smoke), and provides, adequate pressure drop (puff resistance), firmness and homogeneous cross section of filter, to a production method of such tobacco filter, and to a tobacco provided with the tobacco filter.

BACKGROUND OF THE INVENTION

As a tobacco filter which removes tars from the tobacco smoke and insures a satisfactory smoking quality, a filter plug prepared by shaping a fiber bundle of cellulose acetate fibers with a plasticizer such as triacetin is generally used. This filter has an adequate pressure drop and satisfactory cross section, and, in this filter, the constituent filaments have been partly fused together by the plasticizer to be shaped, so that the filter has a suitable firmness as required of a filter. By the same reason, however, when such filter is discarded after smoking, it takes a long time for the filter plug to disintegrate itself in the environment, thus adding to the pollution problem.

Meanwhile, a tobacco smoke filter made of a creped paper manufactured from a wood pulp sheet and a tobacco filter made from a regenerated cellulose fiber bundle are also known. Compared with a filter plug comprising a cellulose acetate fiber, these filters are slightly more wet-disintegratable and, thus, of somewhat lower pollution potential. However, in these filters, not only the aroma and palatability of tobacco smoke are sacrificed but also the efficiency of selective elimination of phenols which is essential to tobacco filters can hardly be expected.

Further, according to a conventional technology which comprises creping and/or embossing a sheet-like material and wrapping up the creped and/or embossed material into a rod filter, an adequate pressure drop (puff resistance, such a suitable firmness as not to impart an unpleasant feeling to a smoker and a homogeneity of a cross section can hardly be expected concurrently. By way of example, a firmness of a filter can be enhanced by use of a plasticizer or a specialized binder as in, for instance, a filter made of a cellulose acetate fiber bundle, or by modifying the cross-sectional configuration of a constituent fiber. The pressure drop of such filter may easily be regulated by adjusting depth of crepes or embosses formed by creping or embossing process. However, adjustment of the pressure drop to an adequate range results in coarse structure (tissue) of the filter, so that the firmness of the filter is decreased and cross section of the filter becomes heterogeneous. Therefore, a filter having satisfactory properties can hardly be obtained.

SUMMARY OF THE INVENTION

It is, therefore, an object of the present invention to provide a tobacco filter which insures an adequate pressure drop and firmness, and high homogeneity (uniformity) of the cross-sectional structure, a method of producing the filter, and a tobacco as produced using such filter.

It is another object of this invention to provide a tobacco filter which insures satisfactory aroma, taste and palatability of tobacco smoke and efficient elimination of harmful components of tobacco smoke, a production method of such tobacco filter, and a tobacco as produced using the tobacco filter.

A further object of the present invention is to provide a tobacco filter which is highly wet disintegratable and, hence, contributory to mitigation of pollution problem, a method of producing the same and a tobacco as produced with the use of such filter.

It is yet another object of the present invention to provide a method of producing a tobacco filter having such excellent characteristics as mentioned above in a simple and easy manner with high efficiency.

The inventors of the present invention did an intensive research to accomplish the above-mentioned objects, and found that a selective combination of the characteristics of a sheet comprising a cellulose ester with the conditions of manufacture of a filter using such sheet results in a tobacco filter which insures satisfactory smoking quality and sufficient elimination of harmful components of tobacco smoke and yet provides an adequate pressure drop, high firmness (hardness) and small cross-sectional porosity. The present invention has been accomplished on the basis of the above findings.

Thus, the tobacco filter of the present invention is a rod-form tobacco filter formed by creping or embossing a mater:al in the form of a sheet having a web structure and comprising a cellulose ester component, and wrapping up the creped or embossed material, and has a pressure drop of 200 to 500 mm water gauge, a firmness of not less than 88% and a cross-sectional porosity of not more than 2% provided that the filter has a circumferential length of 24.5±0.2 mm and a length of 10±0.2 cm.

The amount of the cellulose ester component may be not less than 20% by weight based on the total amount of the sheet-like material. The packing density (bulk density) as indicated by the following equation may be 0.15 to 0.20 ($g/cm^3$):

$$D=F/(S\times L)$$

wherein D represents a packing density ($g/cm^3$) of the sheet-like material, F represents a packing or charging amount (g) of the sheet-like material, S denotes a sectional area ($cm^2$) of the filter, and L means a filter length (cm).

The circumferential length of the filter may be about 17 to 27 mm. The cellulose ester component may practically be at least one member selected from the group consisting of (1) a cellulose ester fiber or particle, (2) a fibrillated cellulose ester fiber and (3) a fiber or particle comprising a base non-esterified cellulose and a cellulose ester. The fiber or particle (3) may be a fiber or particle having a core and a surface layer surrounding the core, where the surface layer comprises a cellulose ester and the core comprises a non-esterified cellulose. The fiber or particle (3) may be (a) coated cellulose comprising a fibrous or particulate cellulose and a cellulose ester wherein the surface of the fibrous or particulate cellulose is coated with the cellulose ester, or (b) a fibrous or particulate cellulose derivative derived from a naturally-occurring cellulose or regenerated cellulose fiber or particle, wherein an esterified portion in the surface layer and a non-esterified portion in the core are formed by esterification of the surface of the fiber or particle. The cellulose ester component may practically be in the form of a short staple.

The sheet-like material may comprise the cellulose ester component and a beaten pulp. Further, the filter may be degradable on contact with water.

According to the method of the present invention, a sheet-like material comprising a cellulose ester component is creped and/or embossed and wrapped up into a rod form to provide a filter having a pressure drop of 200 to 500 mm water gauge, a firmness (hardness) of not less than 88% and a cross-sectional porosity of not more than 2% as determined with a proviso that the filter has a circumferential length of 24.5±0.2 mm and a length of 10±0.2 cm. This method includes an embodiment which comprises creping and/or embossing a material in the form of a sheet having a web structure with the use of a roll with a temperature of not lower than 100° C., and wrapping up the creped or embossed material into a rod form with a packing density (filled density) of 0.15 to 0.20 g/cm$^3$, where the material comprises a short staple of the cellulose ester component and a beaten pulp and has a basis weight of 10 to 60 g/m$^2$ and a density of 0.25 to 0.45 g/cm$^3$.

The tobacco of the present invention is provided with the above tobacco filter.

It should be understood that the term "cellulose ester component" as used in this specification means and includes, in addition to a cellulose ester as such, a particle or fiber wherein the greater part of its surface is coated with, or composed of a cellulose ester.

The terms "pressure drop", "firmness" and "sectional porosity" respectively mean data evaluated by the following manners.

"Pressure Drop": It is a value as determined by a sealed method with the use of an automatic test station FTS300 manufactured by Filtrona Co., Ltd. That is, the pressure drop is indicated as a pressure loss in terms of water gauge (mm water gauge) provided that the rate of air flow passing through the filter is 17.5 ml/sec.

"Firmness": It is a value (%) as determined using an automatic hardness tester AHT400 manufactured by Filtrona Co., Ltd. Namely, under predetermined conditions, a dead weight weighing 300 g is placed on a filter and the amount of depression is determined and the firmness is calculated according the following equation:

$$\text{Firmness } (\%)=(B/A)\times 100$$

wherein A represents a diameter of the filter before weighing the weight on the filter, and B denotes a diameter of the filter after weighing the weight.

"Cross-sectional Porosity": A filter cut into a length of 15 mm is wrapped with a black paper in order to prevent an influence or effect of an external light, and a light with a lighting level of 7 ($42\times10^4$ lux) is irradiated from one end face of the filter. The irradiation is conducted in such a condition that a light guide (500 mm in diameter) installed on a lighting apparatus (Kenko Co., Ltd., Japan, KPS-100R) contacts with the end face of the filter. The image of light and shadow formed by a light passed through to the other end of the filter is transformed to light quantity level with 256 graduations using an image treating apparatus. The graduation part with a light quantity level of not less than 90 is defined as a pore, and the cross-sectional porosity is calculated as a ratio of the pore (%) based on the total surface area.

DETAILED DESCRIPTION OF THE INVENTION

The cellulose ester used in the present invention includes, for example, cellulose acetate, cellulose propionate, cellulose butyrate and other organic acid esters; cellulose nitrate, cellulose sulfate, cellulose phosphate and other inorganic acid esters; cellulose acetate propionate, cellulose acetate butyrate, cellulose acetate phthalate, cellulose acetate nitrate and other mixed acid esters; and polycaprolactone-grafted cellulose acetate and other cellulose ester derivatives. These cellulose esters can be used singly or in combination.

While the average degree of substitution of a cellulose ester is generally in the range of about 1 to 3, use of those species with average degrees of substitution in the range of about 1 to 2.15, preferably about 1.1 to 2.0, provides an improved high biodegradability and hence is useful for minimizing the pollution burden on the environment, as proposed in Japanese Patent Application Laid-open No. 76632/1995 (JP-A-7-76632).

The preferred example of the cellulose ester includes organic acid esters (for example esters with an organic acid having about 2 to 4 carbon atoms), among which a cellulose acetate is particularly desirable. The average degree of substitution of such cellulose acetate may preferably be in the range of about 1.5 to 3 (e.g. about 2 to 3).

Incidentally, use of a cellulosic fiber or particle in which at least its surface or surface layer contributing to filtration of tobacco smoke comprises a cellulose ester (e.g. a cellulose acetate with an average substitution degree of about 1.5 to 3) results in excellent filtrating properties such as satisfactory smoking qualities (taste, aroma and palatability) of tobacco smoke and elimination efficiency of tars, even when the substitution degree as a whole is lower than the above-specified range. Examples of such cellulosic fiber or particle include an esterified cellulose article in which its surface is esterified (e.g. a fibrous or particulate cellulose derivative derived from a naturally-occurring or regenerated cellulose and its surface is esterified with an organic acid or an anhydride thereof, or an inorganic acid (for instance, an organic acid having about 2 to 4 carbon atoms or its anhydride)), a coated article as produced by coating an article with a cellulose ester (e.g. a fibrous or particulate cellulose comprising fibrous or particulate cellulose such as a wood pulp wherein the surface of the fibrous or particulate cellulose is coated with a cellulose ester) and so on. Such cellulose derivative and coated cellulose contain cores each comprising a non-esterified cellulose so that they are highly biodegradable.

Incidentally, a fiber or particle comprising a base non-esterified cellulose (e.g. a naturally-occurring or regenerated cellulose) and a cellulose ester can also be employed for its high biodegradability. Such fiber or particle includes, but is not limited to, the above fiber or particle wherein at least the surface or surface layer thereof comprises a cellulose ester. The cellulose ester portion in such fiber or particle may not necessarily reside in the surface or surface layer.

The shape (configuration) of the cellulose ester component is not particularly restricted, and it may be either of a particle (e.g. a powder) or fiber. The preferred cellulose ester component comprises at least a cellulose ester fiber. The cellulose ester fiber includes, for instance, (i) a fibrous cellulose ester obtainable by a conventional spinning technology, (ii) a fibrillated cellulose ester fiber (e.g. a fibrillated cellulose ester fiber having an average diameter of 15 to 250 $\mu$m, preferably about 20 to 200 $\mu$m and more preferably about 30 to 150 $\mu$m, and a BET (Brunaue-Emmet-Tellar equation) specific surface area of 0.5 to 4.5 m$^2$/g, preferably about 0.5 to 4 m$^2$/g (e.g. about 1 to 3 m$^2$/g) and more preferably about 0.7 to 3.8 m$^2$/g (e.g. 0.7 to 3.5 m$^2$/g), which is obtainable by extruding a cellulose ester solution from a nozzle into a precipitating agent for the cellulose ester and causing a shear force to act on the extrudate while precipitating, as described in Japanese Patent Application No. 282584/1994), (iii) an esterified cellulose fiber in which the surface of the fiber is esterified (for instance, as described in Japanese Patent Application No. 280053/1994, a fibrous cellulose derivative derived from a naturally-occurring or regenerated cellulose in which the surface of the fiber is esterified with an organic acid or an acid anhydride thereof), (iv) a coated fiber coated with a cellulose ester (e.g. a coated fiber in which a fibrous cellulose such as a wood pulp is coated with a cellulose ester as described in Japanese Patent Application No. 254557/1994) and the like. The cellulose derivative such as the esterified fiber may have, as a whole, an average degree of substitution of not more than 1.5 (e.g. about 0.01 to 1.5), preferably about 0.02 to 1.2, and more preferably about 0.05 to 0.5, and the coated cellulose such as the coated cellulose fiber may be coated with the cellulose ester in a proportion of not less than 0.1% by weight, (e.g. about 0.1 to 50% by weight), preferably not less than 1% by weight (e.g. about 1 to 30% by weight), more preferably not less than 3% by weight (e.g. about 3% to 15% by weight) based on the total amount of the coated cellulose. The coated cellulose may frequently be coated with the cellulose ester in an amount of about 0.5 to 15% by weight, and preferably about 1 to 12% by weight based on the total amount of the coated cellulose.

These cellulose ester components may be used independently, or in combination, for example, as a combination of a particulate cellulose ester and a fibrous cellulose ester, or a combination of cellulose ester fibers different in species.

For the purpose of preparation of the sheet-like material with a high efficiency, fibrous articles such as (i) a cellulose ester fiber obtainable by spinning, (ii) a fibrillated cellulose ester fiber, (iii) an esterified cellulose, and (iv) a fiber coated with a cellulose ester can advantageously be employed. From a viewpoint of improvement or enhancement of the wet disintegratability of the material, such species of cellulose ester components as a cellulose ester short staple, (ii) a fibrillated cellulose ester fiber, (iii) an esterified cellulose fiber and (iv) a fiber coated with a cellulose ester are desirable.

Cellulose ester fibers, in particular cellulose ester short staples can preferably be used for obtaining a sheet-like material comprising a cellulose ester.

The length of the cellulose ester fiber is not specifically restricted insofar as not sacrificing the webbing property (web-formability) of the material. When the sheet is prepared according to a conventional wet-webbing technology, or for the purpose of enhancing the disintegratability in the environment, the average fiber length is for example about 1 to 10 mm, and preferably about 2 to 8 mm. The fiber with a length of about 3 to 7 mm may practically be employed. When the fiber length is too short, the cost for manufacturing the short staple is likely to be increased and the sheet strength tends to be sacrificed so that a problem such as cutting of a product sheet during a wrapping up process may be occurred. Contrary to this, use of a fiber having an excessively long fiber length may sacrifice the dispersibility in water and, hence, a sheet can hardly be manufactured by wet webbing and satisfactory disintegratability in the environment can hardly be expected.

The fineness of the cellulose ester fiber may for example be about 1 to 10 deniers, preferably about 2 to 8 deniers (e.g. about 2 to 7 deniers), and more preferably about 3 to e deniers. Such a fiber having a fineness of less than 1 denier requires a specialized technique for spinning, and can hardly be manufactured according to a manner generally employed. On the other hand, if the fineness is greater than 10 deniers, the filtration efficiency will be sacrificed and the strength of the sheet may become excessively low so that the material would hardly be rolled up or wrapped up to cause a lower uniformity of the cross section of a product filter plug.

The cellulose ester fiber may be whichever of a crimped or non-crimped fiber, but is preferably used in the non-crimped form for enhancing the web-formability, wet disintegratability or dispersibility.

The cross-sectional configuration of the cellulose ester fiber is not particularly restricted and may for example be circular, elliptical, polygonal such as trigonal (triangular), and other modified or irregular cross section. A cellulose ester fiber having a modified cross section can advantageously be used for improving the permeability of the filter (refer to Japanese Patent Application No. 292149/1994). In the cellulose ester fiber having a modified cross section, the ratio R of the diameter D1 of a circumscribed circle of the cross section of the fiber (circumscribed circle relative to the diameter D2 of an inscribed circle of the cross section (inscribed circle) may be such that the former D1/the latter D2 is in the range of not less than 2, preferably about 2.2 to 6, more preferably about 2.3 to 5 and particularly about 3 to 5. Use of a fiber having such cross section results in a filter having a high firmness (hardness) despite its low pressure drop (puff resistance) and also having improved filtration properties. The cross-sectional configuration of the cellulose ester fiber having a modified cross section may be whichever of X-, Y-, H-, R-, I- or other configuration. Among them, X-, Y-, H- or I-configured fiber may preferably be employed, and a fiber having a Y-configured cross section is particularly desirable.

The tobacco filter material in the form of a sheet may only comprise the cellulose ester component in such a proportion as not to deteriorate the smoking quality and filtrating properties for tobacco smoke, and have a web structure. The content of the cellulose ester component is for example not less than 20% by weight (e.g. about 30 to 100% by weight), preferably not less than 40% by weight (e.g. about 45 to 100%), and more preferably not less than 50% by weight (e.g. about 50 to 100% by weight.) based on the total amount of the sheet-like material. Meanwhile, a particle or fiber (short staple) of a cellulose ester as it is may practically be deficient in self-adhesive properties and web-formability (paper-formability) and hence a sheet-like material with good qualities can hardly be obtained when such cellulose ester fiber or particle and no other is used for the filter material. In such a case, the cellulose ester component may preferably be molded into a sheet form together with a beaten pulp and/or a binder (e.g. a binder comprising a naturally-occurring or synthetic resin). In a preferred embodiment, the cellulose ester component (preferably a cellulose ester short staple) may practically be mix-webbed at least with a beaten pulp.

It should be understood that the term "beaten pulp" as used in this specification includes, within its meaning, a pulp comprising a naturally-occurring cellulose fiber such as a wood pulp, linter, hemp, etc., as well as a pulp made of a synthetic resin, each of which has been beaten with the use of a conventional beating machine (beater) or cracking machine. As the beaten pulp, a wood pulp obtainable from a soft wood or hard wood according to a conventional technology such as the sulfite method, kraft method or others is generally employed. The beaten pulp is fibrillated by beating to possess or develop paper-making properties (paper-formability).

The degree of beating may be selected from a range not adversely affecting the web-formability in a system comprising both of the cellulose ester component (e.g. a cellulose ester fiber) and the beaten pulp, and is for example such that a Shopper-Riegler freeness is in the range of about 10 to 90° SR (e.g. about 20 to 90° SR), preferably about 20 to 80° SR, and more preferably about 25 to 75° SR (e.g. about 30 to 70° SR). Practically, a beaten pulp with a Schopper-Riegler freeness of about 30 to 60° SR is employed. If the degree of beating is too much low, the entanglement or interlacing of the cellulose ester component (e.g. cellulose ester short staples) is not sufficient so that the cellulose ester component can hardly be adhered and hence the strength of the sheet is liable to be deteriorated. On the other hand, use of a beaten pulp having an excessively high degree of beating causes an excessive binding force and adhering properties of components (fibers) so that the disintegratability of the material tends to be sacrificed.

The relative proportion of the cellulose ester component (e.g. a cellulose ester short staple) to the beaten pulp can liberally be selected from any range only if the content of the cellulose ester component is in the range of not less than 20% by weight (for example not less than 40% by weight, and preferably not ess than 50% by weight) for obtaining a filter having satisfactory smoking quality and excellent filtrating properties. The proportion of the cellulose ester component relative to the beaten pulp is such that the former/the latter is about 90/10 to 20/80 (by weight), preferably about 80/20 to 20/80 (by weight), more preferably about 75/25 to 35/65 (by weight) and practically about 70/30 to 40/60 (by weight). The cellulose ester component and the beaten pulp may practically be used in such a proportion that the former/the latter equals about 90/10 to 43/60 (by weight), preferably about 80/20 to 40/60 (by weight), and more preferably about 70/30 to 50/50 (by weight).

Where necessary, in lieu of or together with the beaten pulp, a microfibrillated cellulose (e.g. microfibrillated fibrous substance having a fiber diameter of not exceeding 2 $\mu$m and a fiber length of 50 to 1,000 $\mu$m may be incorporated into the material. The amount of the microfibrillated cellulose is about 0.1 to 10% by weight based on the total weight of the filter (refer to Japanese Patent Application No. 239402/1994). Use of the microfibrillated cellulose insures an enhanced adhesive property to the particulate or fibrous cellulose ester component and paper-formability (web-formability) of the material and hence an improved paper strength.

If necessary, a naturally-occurring or synthetic resin binder may be incorporated in preparation of the sheet-like material. In particular, when the content of the cellulose ester particle or fiber (e.g. short staple) is comparatively high or the sheet is prepared in a non-woven form by dry-webbing technique, incorporation of a binder to some extent may occasionally be required. As the binder, there may be employed binders of species that do not adversely affect on human body and not deteriorate the aroma, taste and palatability of tobacco smoke (smoking quality) and the disintegratability. Examples of such binder include binders belonging to food additives and being odorless. The amount of the binder may preferably as small as possible, and is, for instance, not more than 10% by weight (e.g. about 0.1 to 10% by weight), preferably about 0.3 to 8% by weight (e.g. about 0.5 to 7% by weight) based on the total weight of the material.

The binder may be a binder being insoluble or sparsely soluble in water (e.g. polyethylene, polypropylene, an ethylene-propylene copolymer, an ethylenevinyl acetate copolymer, an ethylene-ethyl acrylate copolymer and other olefinic polymers, acrylic polymers, styrenic polymers, polyesters, polyamides and so on).

Where a wet disintegratability or dispersibility is necessary, a water-soluble binder (water-soluble adhesive) may advantageously be used. As the water-soluble binder, there may be mentioned, for example, natural adhesives such as a starch, a modified starch, a soluble starch, dextran, gum arabic, sodium alginate, casein and gelatin; cellulose derivatives such as carboxymethylcellulose, hydroxyethylcellulose, ethylcellulose, a water-soluble cellulose acetate and the like; and synthetic resin adhesives such as poly(vinyl alcohol), poly(vinyl pyrrolidone), a water-soluble acrylic resin and so forth. These water-soluble adhesives may be employed alone or in combination.

The binder may be used in the form of a liquid such as a solution or a dispersion, or in the form of a particle. Incidentally, a water-insoluble binder in such a small amount that does not interfere with the disintegratability of the material can be employed even when the wet disintegratability is required. By similar token, a binder which causes an odor or smell may be utilized as far as not deteriorating the aroma, taste and palatability of tobacco smoke. Further, even if the disintegratability or dispersibility is required, a plasticizer for cellulose ester may also be employed within a range not deteriorating the disintegratability.

The tobacco smoke filter material in the form of a sheet comprises the above-mentioned constitute components and has a nonwoven web structure. The term "web structure" is used herein to mean a textural structure in which fibers are interlaced or entangled as in, for example, a sheet or Japanese paper obtainable by web-formation. For the above reason, the sheet-like material, unless using a specific binder, insures rapid disintegration or dispersion when wetted with rain water or the like despite its high dry paper strength.

The sheet-like material may be manufactured by a conventional dry web-formation (paper-making) technology, for example, a technique comprising spraying the cellulose ester component and, when necessary, other component such as the beaten pulp to a permeable support such as a net by means of air flow (air stream). Preferably, the filter material is manufactured by wet webbing technique with the use of a slurry containing the cellulose ester component and the beaten pulp, and as necessary, other component, all of which are dispersed in water. Therefore, preferred web structure includes a web structure obtainable by wet webbing (wet web-formation). The content of solid matters of the slurry can suitably be selected from a range as far as a paper can be formed, and is for example about 0.005 to 0.5% by weight. The webbing can be effected according to a conventional manner, for instance by a technique which comprises fabricating the slurry to form a paper with the use of a wet paper-making machine provided with a perforated panel or other equipment, and dehydrating and drying the resultant web.

The characteristics of the tobacco filter material in the form of a sheet may be within a range not sacrificing the permeability (puffing property), firmness or hardness and homogeneity of the cross section of the filter, and the basis weight of the material is usually about 10 to 40 g/m$^2$, preferably about 15 to 35 g/m$^2$ and more preferably about 25 to 35 g/m$^2$. The material having a basis weight of about 20 to 35 g/m$^2$, preferably about 25 to 35 g/m2 (e.g. about 27 to 35 g/m2) may practically be used. By the same token, the density of the material is, for example, about 0.25 to 0.45 g/cm$^2$, and preferably about 0.30 to 0.45 g/cm$^2$ (e.g. about 0.32 to 0.45 g/cm$^2$). A sheet with a too much small basis weight tends to be very low in paper formability and be sacrificed in the strength of the sheet. On the other hand, if the basis weight of the sheet exceeds such range, crepes or embosses will hardly be formed in a creping or embossing process in the manufacture of a filter so that heterogeneous gaps in the cross section of the filter are apt to be formed and hence a homogeneous or uniform cross section of the filter can hardly be expected. While, use of a sheet with an excessively small density results in deficient strength of the sheet, and when the density is too high, crepe- or emboss-formation in a creping or embossing process is liable to be sacrificed.

Such sheet-like material is useful for the manufacture of a filter having an adequate permeability, a suitable firmness (hardness) and homogeneous cross section.

The tobacco filter of the present invention may be obtained by a conventional manufacturing process, for instance, by wrapping up (rolling up) the sheet-like material into a rod form using a conventional paper filter forming machine. The filter material is preferably creped or embossed for insuring a smooth and uniform passage of tobacco smoke through the filter plug (filer rod) without channeling. In the plug forming machine, the creped or embossed sheet-like material is set in a funnel, wrapped up with a wrapping tissue or paper into a rod (cylinder), glued and cut to length to provide tobacco filters (filter plugs).

Creping can be effected by guiding a sheet material over a pair of creping rollers (rolls) formed with a multiplicity of grooves running in the direction of advance of the sheet material to form winkles or creases, and to a lesser extent fissures along the path of travel. Embossing can be carried out by passing a sheet material over a set of rollers formed with grating-like or random relief pattern. The pitch and depth of the grooves for creping and the pitch and depth of the embossing pattern can be selected from the range of about 0.3 to 5 mm (e.g. about 0.5 to 5 mm) for pitch and the range of about 0.1 to 2 mm (e.g. about 0.1 to 1 mm, preferably about 0.2 to 0.9 mm) for depth. The depth of creping or embossing is practically about 0.3 to 0.6 mm (e.g. about 0.3 to 0.5 mm). The depth of the resultant crepes or embosses can liberally be selected by adjusting a clearance between the rollers even if the depth of the grooves or embossing patterns formed in the rollers is fixed.

In the creping or embossing process, the rollers may be warmed or heated, or may not be warmed or heated. For the purpose of obtaining a tobacco filter having an adequate permeability and firmness and highly homogeneous cross section, the tobacco filter material in the form of a sheet may preferably be creped and/or embossed with the use of warmed or heated creping rollers and/or embossing rollers. According to such technique, crepes, winkles or embossing patterns can easily be formed in a sheet and hence the resultant sheet insures a high firmness in spite of its low pressure drop, and provides satisfactory cross section (homogeneity).

The heating temperature of the rollers can be selected from a suitable range according to the species of the sheet-like material, a desired permeability or other factors, and is for example not lower than 70° C. (e.g. about 80 to 180° C.), preferably not lower than 90° C. (e.g. about 90 to 170° C.), and more preferably not lower than 100° C. (e.g. about 110 to 160° C.). The creping and/or embossing.may practically be conducted with the use of rollers heated at a temperature of about 90 to 170° C., in particular about 100 to 160° C.

The sheet-like material may practically be wrapped up or rolled up into a rod, in particular into a cylinder. In such wrapping up, the packing density (bulk density) also influences on the characteristics of the filter. The packing density of the sheet-like material in association with the wrapping up can be selected from a range not detracting from the pressure drop, firmness or other properties of the filter, and is for instance about 0.15 to 0.20 g/cm$^3$ (e.g. 0.16 to 0.20 g/cm$^3$), and preferably about 0.16 to 0.19 g/cm$^3$. By wrapping up a sheet-like material with such packing density, an adequatate permeability, high firmness and homogeneous cross section can be imparted to a filter with a circumferential length of the cross section of about 15 to 30 mm (preferably about 17 to 27 mm).

The tobacco filter thus obtained has, provided that the filter has a circumferential length of 24.5±0.2 mm and a length of 10±0.2 cm, a pressure drop (puff resistance) of, for example, about 200 to 500 mm water gauge (WG), preferably about 300 to 500 mm water gauge (e.g. about 310 to 490 mm water gauge), and more preferably about 300 to 450 mm water gauge (mm $H_2O$), a firmness of not less than 88% (e.g. about 88 to 95%), and preferably not less than 89% (e.g. about 89 to 93%), and a cross-sectional porosity, as an index for the homogeneity (uniformity) of the cross section, of not higher than 2% (e.g. about 0.3 to 1.7%), preferably not higher than 1.5% (e.g. about 0.5 to 1.5%) and more preferably not higher than 1%. Thus, the filter provides satisfactory characteristics as essential to a filter. Meanwhile, even in a tobacco filter having a circumferential length of about 15 to 30 mm (preferably about 17 to 27 mm), a tobacco filter having satisfactory permeability, firmness and cross-sectional porosity can be obtained by adjusting the packing density of a sheet-like material within the above-specified range.

In the manufacture of tobacco filters or filter plugs, where the gluing along edges of the wrapping paper formed into a rod and gluing between the rodshaped filter material and wrapping paper are necessary, such a water-insoluble binder or water-soluble binder as mentioned above may be employed. The above water-soluble adhesive is preferably used in order that the wet disintegratability or dispersibility will not be adversely affected.

The cellulose ester component and/or the sheet-like tobacco filter material may comprise various additives. Examples of such additives include finely divided powders of inorganic substances including kaolin, talc, diatomaceous earth, quartz, calcium carbonate, barium sulfate, a titanium oxide and alumina; thermal stabilizers such as salts of alkaline earth metals (calcium, magnesium, etc.); colorants (coloring agents); oils; yield improvers; sizing agents; adsorbents such as activated carbons and so forth. In particular, degradation of the filter material in the environment can be increased by incorporating a biodegradation accelerator such as citric acid, tartaric acid, malic acid and the like and/or a photodegradation accelerator such as an anatase-type titanium dioxide into the cellulose ester component (e.g. cellulose ester short staple). Such anatase-type (anatase-form) titanium dioxide may also play a role as a whitening agent (whiteness improver) for the cellulose ester component.

The tobacco according to the present invention is provided or equipped with the tobacco filter (filter tip) mentioned above. The tobacco filter or filter tip may be arranged in any position or site of the tobacco. In the tobacco as produced with the wrapping paper into the form of a rod or cylinder, it is practically arranged in a position with which a mouth of a smoker contacts, or a position between the portion with which a mouth contacts and the cigarette (tobacco). Further, the tobacco filter may contain an adsorbent such as an activated carbon, and the tobacco may be provided with a charged or packed portion in which an adsorbent such as an activated carbon is charged. The circumferential length of the tobacco may practically correspond to the circumferential Length of the filter, and usually is about 15 to 30 mm, and particularly about 17 to 27 mm.

Since the tobacco filter and tobacco of the present invention are formed or produced by creping and/or embossing the sheet-like material comprising a cellulose ester component, and wrapping up the creped and/or embossed material, they insure an adequate or suitable pressure drop, high firmness and highly homogeneous cross section, and hence provide satisfactory puffing feeling. Further, they insure an excellent smoking quality (taste, aroma and palatability), and efficient elimination of harmful components of tobacco smoke. Further, the tobacco filter and tobacco are highly degradable in the environment and thus mitigate the risk of pollution.

According to the method of the present invention, a tobacco filter having excellent characteristics as mentioned above can efficiently be manufactured in such a simple and easy manner as to crepe and/or emboss a sheet-like material obtained by web-formation and wrapping up the creped and/or embossed material into a rod form.

The following examples are intended to describe this invention in more detail but should by no means be construed as defining the scope of the invention.

EXAMPLES

The basis weight, Schopper-Riegler freeness, sheet density, water disintegratability and smoking quality data shown in the examples and comparative examples were determined or evaluated by the following methods.

Basis weight ($g/m^2$): Japanese Industrial Standards (JIS) P-8124

Schopper-Riegler freeness: JIS-P-8121

Sheet density ($g/cm^3$): The sheet density was calculated by the following equation:

$$\text{Sheet density } (g/cm^3) = [\text{Basis weight}(g/m^2)/\text{Sheet thickness}(cm)]/10000$$

wherein the sheet thickness was determined according to JIS-P-8118.

Water disintegratability: About 0.2 g of a sample was put in 200 ml of water in a 300 ml-beaker (75 mm in diameter) and stirred with a magnetic stirrer to that the center height-of the vortex would be equal to ¾ of the highest liquid level. After 10 minutes and 20 minutes, disintegration of the sample was observed, and water disintegratability was evaluated according to the following evaluation criteria of 5 levels.

Evaluation criteria;

A: Completely disintegrated after 10 minutes

B: Not completely disintegrated and a non-disintegrated portion (mass or flocculus) remained after 10 minutes, but disintegrated entirely after 20 minutes C: Even after 20 minutes, a non-disintegrated portion remained, or a mass remained due to re-aggregation or others, although the shape of the sample collapsed D: Even after 20 minutes, not less than 50% of the sample remained without disintegration, or not less than 50% of the sample remained as a mass despite that the shape of the sample was collapsed E: Scarcely any sample disintegrated even after 20 minutes; original shape retained Smoking quality test: Each sample was fabricated into a filter plug and attached to a cigarette [a commercial cigarette Hi-lite (trade mark), Japan Tobacco Incorporation, from which the filter plug had been removed]. A panel of 5 habitual smokers was instructed to evaluate the smoking quality (aroma, taste and palatability) of the sample according to the following scoring criteria. The smoking quality score of the sample was indicated as an average value of the evaluation scores of the 5 subjects.

Organoleptic scoring criteria:

3: Not pungent (hot), with the good taste of tobacco smoke preserved

2: Not pungent (hot) but the taste of tobacco smoke sacrificed to some extent.

1: Pungent or hot

Regarding the pressure drop (mm WG), firmness (%) and cross-sectional porosity (%), 10 or more samples were respectively determined, and the results as mean values of these data are set forth in the Table.

Examples 1 to 8 and Comparative Examples 1 to 5

Sixty (60) parts by weight of a cellulose acetate short staple as shown in Table 1 [each Y-cross section (D1/D2=3.7), fiber length of 4 mm, substitution degree of 2.45] and 40 parts by weight of a bleached soft wood kraft pulp with a beating degree (Schopper-Riegler freeness) of 40° SR were uniformly dispersed in 300,000 parts by weight of water, and using the resultant slurry, a web was wet-fabricated with a paper making machine provided with a round net (cylinder paper-making machine). This web was dehydrated and dried to provide a sheet-like material having a base weight and density shown in Table 1.

The sheet material was creped using creping roller (groove depth of about 0.35 mm to about 0.45 mm) at a roller temperature shown in Table 1, and the creped material was worked up with a packing density indicated in Table 1 to prepare a filter measuring 24.5±0.2 mm in circumference by 10±0.2 cm long. The pressure drop, firmness and cross-sectional porosity of the obtained filter are set forth in Table 1.

TABLE 1

| | Sheet-like material | | Wrap-up condition | | Filter characteristics | | |
|---|---|---|---|---|---|---|---|
| | Basis weight ($g/m^2$) | Density ($g/cm^3$) | Roller temperature (° C.) | Packing density ($g/cm^3$) | Pressure drop (mm WG) | Firmness (%) | Cross-sectional porosity (%) |
| Example 1 | 28 | 0.33 | 120 | 0.17 | 415 | 89.5 | 0.5 |

TABLE 1-continued

| | Sheet-like material | | Wrap-up condition | | Filter characteristics | | |
|---|---|---|---|---|---|---|---|
| | Basis weight ($g/m^2$) | Density ($g/cm^3$) | Roller temperature (° C.) | Packing density ($g/cm^3$) | Pressure drop (mm WG) | Firmness (%) | Cross-sectional porosity (%) |
| Example 2 | 29 | 0.36 | 100 | 0.17 | 490 | 88.3 | 1.3 |
| Example 3 | 29 | 0.35 | 130 | 0.16 | 383 | 90.2 | 0.7 |
| Example 4 | 30 | 0.36 | 130 | 0.17 | 410 | 91.0 | 0.5 |
| Example 5 | 30 | 0.42 | 110 | 0.17 | 377 | 89.3 | 1.0 |
| Example 6 | 31 | 0.43 | 130 | 0.17 | 320 | 89.1 | 0.8 |
| Example 7 | 31 | 0.37 | 130 | 0.18 | 425 | 91.4 | 0.8 |
| Example 8 | 33 | 0.35 | 150 | 0.17 | 470 | 89.8 | 1.4 |
| Comp. Ex. 1 | 27 | 0.36 | 130 | 0.14 | 471 | 86.1 | 1.8 |
| Comp. Ex. 2 | 34 | 0.36 | 20 | 0.21 | 530 | 86.6 | 2.7 |
| Comp. Ex. 3 | 36 | 0.38 | 20 | 0.19 | 570 | 89.1 | 1.0 |
| Comp. Ex. 4 | 37 | 0.41 | 130 | 0.17 | 310 | 88.3 | 5.4 |
| Comp. Ex. 5 | 37 | 0.38 | 20 | 0.18 | 550 | 88.3 | 0.8 |

As apparent from Table 1, the filters according to comparative examples were deficient in either one characteristic of the pressure drop, firmness and cross-sectional homogeneity. To the contrary, the filters according to examples exhibited excellent characteristics as required for a filter, respectively, with a pressure drop in the range of 200 to 500 mm WG, a firmness of 88% or more and a cross-sectional porosity of not more than 2%. The sheet materials according to Examples 1 to 8 showed excellent disintegratability or dispersibility each with a water disintegratability of level "A". Further, the filters according to Examples 1 to 8 showed satisfactory smoking qualities with smoking quality scores in the range of 2.2 to 3.0.

Example 9

A softwood sulfite pulp (α-cellulose content 92%), as the substrate cellulose, was acetylated using acetic anhydride as acetylating agent, sulfuric acid as catalyst, and acetic acid as reaction solvent and, then, aged (hydrolyzed) to provide a spinning dope with a composition of cellulose diacetate: acetic acid: water=20:60:20 (by weight). This dope was adjusted to a temperature of 60° C. On the other hand, an aqueous acetic acid solution of 10% by weight concentration was prepared and adjusted to 20° C. for use as a coagulation agent.

For the manufacture of a fiber, an apparatus equipped with a pipe provided with a conduit for supply of the coagulation fluid, a nozzle disposed in the pipe and provided with orifices formed in the downstream end wall of a nozzle casing for extruding the dope and delivering it into the conduit, and a cutting means (cutter) disposed in the downstream direction of the nozzle. With the above equipment, a partially fibrillated cellulose acetate fiber was manufactured. That is, the coagulation agent prepared above was passed down the conduit of the pipe. Simultaneously, the dope prepared above was extruded from the orifices of the nozzle into the coagulation agent while it was cut with the cutter before complete coagulation or precipitation, whereupon the cellulose acetate extrudate was partially fibrillated by the shear force of the cutter to provide a partially fibrillated cellulose acetate fiber.

The fiber thus obtained was centrifugally dehydrated and rinsed with warm water at 50° C. to remove the solvent. The apparent diameter of the fiber in wet condition as observed under the microscope was within the range of 50 to 150 μm. the fiber was then immersed in boiling water at 100° C. for 30 minutes, at the end of which time it was dehydrated. When this fiber was dried in a hot air current at 90° C., a soft, flocculent fiber mass was obtained.

Fifty five (55) parts by weight of this fibrillated cellulose acetate fiber (constituent fiber with a dry fiber length in the range of about 0.3 to 2 mm and a BET specific surface area of 3.8 $m^2/g$) and 45 parts by weight of a bleached soft wood kraft pulp with a beating degree of 45° SR were dispersed homogeneously in 300,000 parts by weight of water to prepare an aqueous dispersion (slurry). This slurry was wet-webbed using a paper-making machine provided with a round net, dehydrated and dried to provide a sheet-like material with a basis weight of 30 $g/m^2$ and a density of 0.44 $g/cm^3$.

This sheet-like material was creped with the use of a creping roller (crepe depth of 0.35 mm) at a creping roller temperature of 130° C. The creped material was worked up with a packing density of 0.18 $g/cm^3$ to prepare a filter with a circumferential length of 24.5±0.2 mm and a length of 10±0.2 cm. The characteristics of the filter were determined and the filter showed a pressure drop of 420 mm WG, a firmness of 89.0% and a cross-sectional porosity of 1.2%. The water disintegratability and smoking quality of the filter were level "B" and score "12.7" respectively, and hence this filter was superior in characteristics required for a tobacco filter.

Example 10

In 1,000 ml of water was dipped 10 g of a soft-wood sulfite pulp (α-cellulose content 94%) for 1 hour and the dipped pulp was dehydrated (condensed) up to containing 5 times of water relative to the pulp, and the resultant was substituted with 100 ml of acetic acid. Further, 600 ml of acetic acid and 600 ml of acetic anhydride were added to the above mixture, and the reaction was carried out under a nitrogen gas flow using an oil bath at 80 C. for 1 hour. The reaction product was put into 3,000 ml of water, and thus excess of acetic anhydride was decomposed. The resultant was separated by filtration, rinsed with water and dried to provide a fibrous cellulose derivative (fiber length of 4 mm, fiber diameter of 20 μm) with an average degree of substitution of 0.15.

The biodegradability of this fibrous cellulose derivative was 61%. The biodegradability was evaluated according to American Society for Testing and Materials (ASTM) D 5209-91 with the use of an active sludge of a municipal sewage treating plant as the active sludge. As the test sample, 2 grams of each test material was preliminarily frozen in liquefied nitrogen for 3 minutes and then ground in a coffee mill for 3 minutes. The ground material was frozen in liquefied nitrogen for 1 minute and then pulverized with a vibration pulverizer for 3 minutes to give a test sample (100 mesh pass). Using the test sample at a concentration of 100 ppm (charge 30 mg) and the active sludge at a concentration of 30 ppm (charge 9 mg), the test was carried out at 25±1° C. for 4 weeks. The amount of evolved carbon dioxide was converted to the number of liberated carbon atoms and the decomposition rate was calculated as the percentage relative to the total number of carbon atoms in the test sample.

While, the fibrous cellulose derivative was dyed with a disperse dye (Disperse Yellow 3, manufactured by Aldrich Chemical Company Inc.) and cross section of the fiber was observed with the use of a microscope. As a result, only the outer region (surface layer) of the fiber was dyed with the disperse dye and hence it was confirmed that only the surface layer of the fiber was selectively acetylated.

The sulfite pulp in which its surface was selectively acetylated (average substitution degree of 0.15; 70 parts by weight) and a soft wood bleached kraft pulp with a beating degree of 45° SR (30 parts by weight) were dispersed homogeneously in 300,000 parts by weight of water to give a slurry. By using this slurry, a web was wet-fabricated with the use of a paper making machine provided with a round net, and the web was dehydrated and dried to provide a sheet-like material having a basis weight of 30 g/m$^2$ and a density of 0.42 g/cm$^3$.

The sheet-like material was creped (crepe depth of 0.40 mm) with a creping roller at a roller temperature of 120° C., and the creped material was worked or wrapped up with a packing density of 0.18 g/cm$^3$ to provide a filter measuring 24.5±0.2 mm in circumferential length and 10±0.2 cm in length. By determining the characteristics of the filter, the filter exhibited a pressure drop of 435 mm WG, a firmness of 89.5% and a cross-sectional porosity of 0.9%. The water disintegratability and the smoking quality score of the filter were level "A" and score "2.4", respectively. Thus, it was evidenced that the filter was excellent in characteristics as required for a tobacco filter.

What is claimed is:

1. A method of producing a tobacco filter having a pressure drop of 200 to 500 mm water gauge, a firmness of not less than 88% and a cross-sectional porosity of not more than 2% as determined with a proviso that the filter has a circumferential length of 24.5±0.2 mm and a length of 10±0.2 cm, which comprises creeping or embossing a material in the form of a sheet comprising a cellulose ester component and wrapping up the creeped or embossed material into a rod form.

2. A method of producing a tobacco filter as claimed in claim 1 is which comprises the steps of:

creeping or embossing a sheet-like material having a web structure, said material comprising a short staple of a cellulose ester component and a beaten pulp and having a basis weight of 10 to 40 g/m$^2$ and a density of 0.25 to 0.45 g/m$^3$, with the use of a roll with a temperature of not lower than 100° C., and wrapping up the creped or embossed material into the form of a rod with a packing density of 0.15 to 0.20 g/m$^3$.

3. A method of producing a tobacco filter as claimed in claim 2, wherein the creping or embossing step is conducted using a sheet-like material having a basis weight of 20 to 35 g/m$^2$ and a density of 0.30 to 0.45 g/cm$^3$ with the use of a roll with a temperature of 100 to 160° C., and the wrapping up step is carried out to give a rod form filter with a packing density of 0.16 to 0.19 g/cm$^3$.

* * * * *